US006915675B2

(12) United States Patent
Perotti

(10) Patent No.: US 6,915,675 B2
(45) Date of Patent: Jul. 12, 2005

(54) HIGH THERMAL EFFICIENCY HEAT EXCHANGER, PARTIALLY CORRUGATED SHEET METAL FOR HEAT EXCHANGERS, PLANT AND PROCEDURE FOR OBTAINING SAID PARTIALLY CORRUGATED SHEET METAL

(75) Inventor: Paolo Perotti, Verona (IT)

(73) Assignee: Cosmotec S.p.A. (IT)

( * ) Notice: Subject to any disclaimer, the term of this patent is extended or adjusted under 35 U.S.C. 154(b) by 235 days.

(21) Appl. No.: 10/276,452

(22) PCT Filed: Apr. 13, 2001

(86) PCT No.: PCT/IT01/00188

§ 371 (c)(1),
(2), (4) Date: Nov. 18, 2002

(87) PCT Pub. No.: WO01/78916

PCT Pub. Date: Oct. 25, 2001

(65) Prior Publication Data

US 2004/0231386 A1 Nov. 25, 2004

(30) Foreign Application Priority Data

Apr. 19, 2000 (IT) ..... VR2000A0032

(51) Int. Cl.[7] ..... B21D 13/08
(52) U.S. Cl. ..... 72/187; 72/379.6
(58) Field of Search ..... 72/184, 187, 196, 72/383, 379.6

(56) References Cited

U.S. PATENT DOCUMENTS 1,749,342 A * 3/1930 Hazen ..... 72/130
6,195,874 B1 * 3/2001 Chen et al. ..... 29/727

FOREIGN PATENT DOCUMENTS

| | | |
|---|---|---|
| DE | 32 26 024 A | 1/1984 |
| DE | 34 16 840 A | 11/1985 |
| EP | 0 775 540 A | 5/1997 |
| WO | WO 95 30867 A | 11/1995 |

OTHER PUBLICATIONS

International Search Report issued Oct. 19, 2001.

* cited by examiner

*Primary Examiner*—Lowell A. Larson
(74) *Attorney, Agent, or Firm*—Charles Berman, Esq.; Greenberg Traurig, LLP

(57) ABSTRACT

A procedure for obtaining partially corrugated sheet metal (11) comprises the following work phases: provision of a roll of sheet metal (11) to feed a respective means of unrolling and transferring said sheet metal (11); compression of said sheet (11) in such a way as to produce a series of transverse corrugations alternating with flat sections on the sheet (11); transfer of said sheet (11) towards a press brake (16) to fold the sheet, parallel to the axis of the corrugations, in correspondence of the central portion of each flat section, and in the opposite direction with respect to the fold of the previous flat section in such a way as to obtain a coil of sheet metal (11) with corrugations on adjacent sides; extraction of the corrugated sheet (11) from the press brake (16) and shearing of said sheet (11) into pre-established lengths. Through such procedure it is possible to manufacture an improved air-air plate-type heat exchanger.

6 Claims, 4 Drawing Sheets

Figure 1:
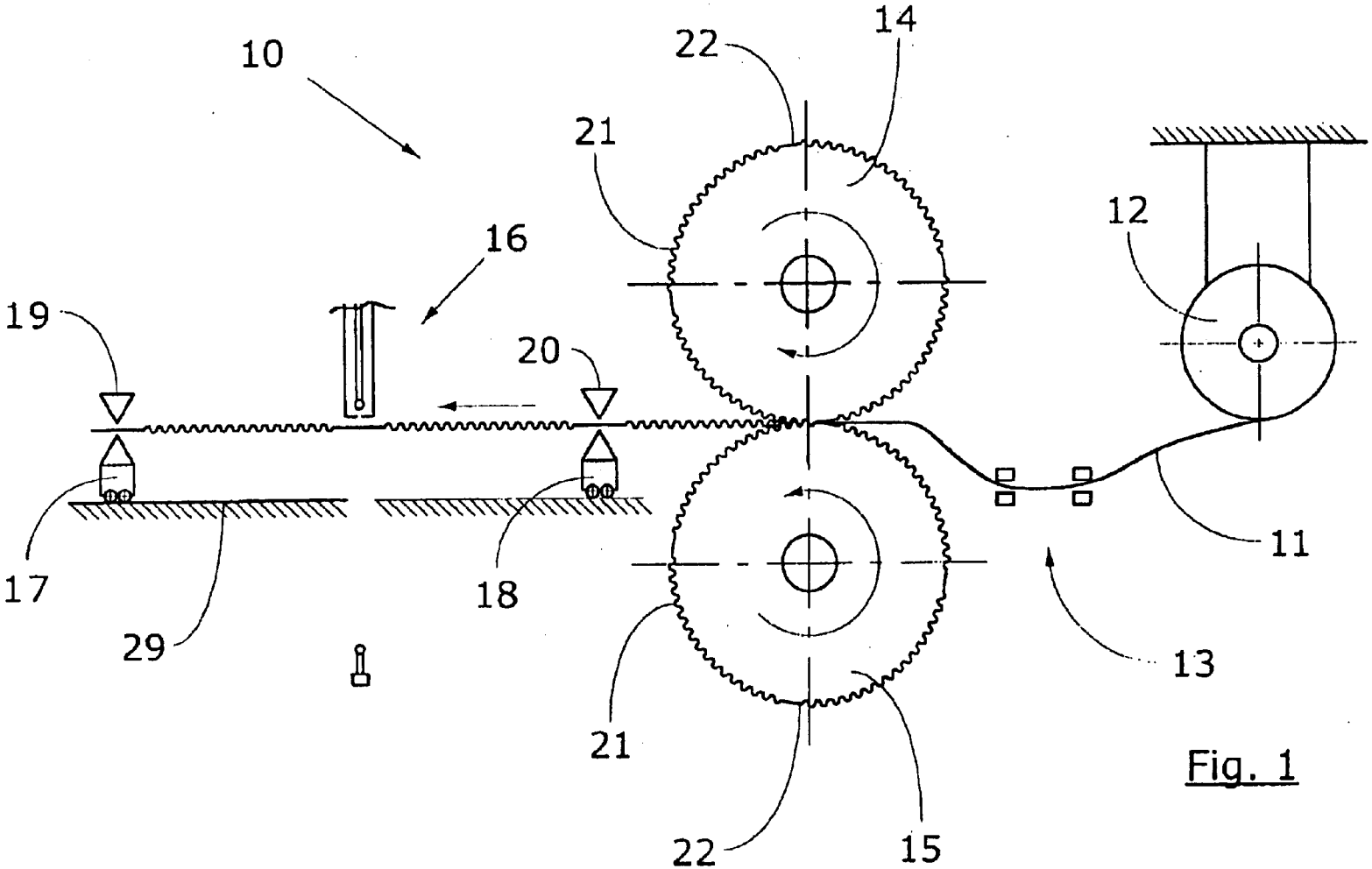

HIGH THERMAL EFFICIENCY HEAT EXCHANGER, PARTIALLY CORRUGATED SHEET METAL FOR HEAT EXCHANGERS, PLANT AND PROCEDURE FOR OBTAINING SAID PARTIALLY CORRUGATED SHEET METAL

TECHNICAL FIELD

The present invention concerns a high thermal efficiency heat exchanger, partially corrugated sheet metal appropriate for constructing said heat exchanger and plant and procedure for obtaining said partially corrugated sheet metal.

More specifically, it concerns an air-air heat exchanger for electrical cabinets with a structure able to guarantee efficient heat exchange between a cold fluid and a hot fluid.

BACKGROUND ART

It is a well known fact that an air-air heat exchanger for cooling electrical cabinets generally consists of a plate pack arranged in such a way as to obtain two separate circuits for hot air and cooling air respectively.

The latter eliminates the heat content of the former in a relatively short space of time in relation to the mass flows and the surface area of contact between the fluids and said plate pack.

As the kinetic contribution of the fluid is a determining factor in guaranteeing efficient heat exchange, both circuits are often equipped with a respective means, for example a fan, of rapidly moving the air.

The plate pack is housed inside a casing, usually of metal, positioned next to the metal cabinet to be cooled and in communication with the interior of said cabinet in such a way as to eliminate heat and thus cool the air present in the cabinet.

According to an embodiment known in the art, the plate pack is formed from a single roll of sheet metal, usually aluminium, which is unrolled and then folded into an "accordion" configuration in such a way as to create a number of passages, further circumscribed by the inner surfaces of the casing and strips of insulating material. One problem with this embodiment is that the sheet metal has a flat surface and heat exchange is thus relatively low.

This can be compensated for by increasing the flow rate of the fluid, but this results in considerable energy dispersion due to localised pressure drop in relation to the square of its speed.

Also known in the art is the use of corrugated plate packs offering a higher exchange surface area for the same longitudinal dimensions.

One disadvantage of this technique is that its use is limited to packs consisting of a number of separate superimposed sheets, without them being folded into an "accordion" configuration by unrolling the sheet metal from a roll, as the folding operation would induce longitudinal tension and thus tend to reduce the curvature of the corrugations.

In addition, it is difficult to fold the sheet metal in correspondence to the corrugations and relatively thick material must therefore be used.

A further problem is that in an air-air heat exchanger made from flat sheet metal, the intake and outlet are usually opposite each other on the diagonal of the casing.

The air thus tends to cross the heat exchanger following the shortest possible route, excluding peripheral parts of the casing from the heat exchange process and consequently drastically reducing efficiency.

DESCRIPTION OF THE INVENTION

This invention aims to provide a procedure to obtain partially corrugated sheet metal particularly appropriate for the construction of the heat exchange circuits of heat exchangers.

According to another aspect, this invention aims to provide plant for producing partially corrugated sheet metal.

According to a further aspect, this invention aims to provide partially corrugated sheet metal able to guarantee efficient heat exchange.

According to a final aspect, this invention aims to provide a relatively small lightweight high thermal efficiency heat exchanger, particularly appropriate for cooling electrical cabinets.

This is achieved by means of a procedure for obtaining partially corrugated sheet metal with the features described in the main claim.

The procedure for obtaining partially corrugated sheet metal according to the invention comprises:

- provision of a roll of sheet metal to feed a means of unrolling and transferring said sheet metal;
- compression of said sheet by means of an appropriate roller configured in such a way as to produce transverse corrugations alternating with flat sections on the sheet;
- transfer of the sheet metal towards a press brake to fold the sheet, parallel to the axis of the corrugations, in correspondence to the central portion of each flat section, and in the opposite direction with respect to the fold of the previous flat section in such a way as to obtain a coil with corrugations on adjacent sides;
- extraction of the corrugated sheet from the press brake and shearing of said sheet into pre-established lengths.

According to an advantageous embodiment of this process, a loop control device is provided at the exit from said roller, together with sensors to detect correct infeed of the sheet and transmit the relative signal to an electronic control unit to programme and control the entire procedure.

According to another aspect of this invention, the plant for producing partially corrugated sheet metal comprises the following elements described in order with respect to the infeed of the sheet itself:

- a roll-holder for the sheet metal and means of unrolling said sheet;
- a device for transfer of said sheet;
- a loop control device;
- a pair of opposing cylinders, kinematically connected to a respective source of motion, with longitudinal bands on the work surface with corrugations transverse to the direction of infeed of the sheet;
- a press brake comprising;
- a bed plate supporting the guides housing the respective sliding carriages, each equipped with gripping means for said sheet metal, free to move from a central work position in which the distance between the two carriages is at a minimum to a reciprocally distant position at the start of the folding cycle;
- a means of moving these carriages kinematically connected to a respective source of motion;
- a punch sliding on a special guide in correspondence to the central work position of the carriages and largely at right-angles to the direction of movement of said carriages, free to move from a stand-by position distant from the sheet metal, into a work position just below the plane of the sliding sheet metal constrained to the carriages themselves;

a counter-punch aligned with the punch and positioned on the opposite side of the sheet metal, sliding in a special guide from a stand-by position distant from the sheet metal into a work position in contact with the sheet itself pushed downwards by said punch;

a pick-up device of the corrugated sheet metal from the press brake;

a shearing machine to cut the corrugated sheet metal into pre-established lengths;

sensors distributed along the path taken by the sheet metal and in correspondence to the elements described previously, electrically connected to an electronic control unit to programme and control the entire procedure According to a further aspect of this invention, the partially corrugated sheet metal comprises a relatively thin metal plate with a number of adjacent corrugated sides linked by flat sections with an alternating curvature in such a way as to form a coil, preferably with a constant pitch.

According to a further aspect of this invention, the high thermal efficiency heat exchanger comprises a casing to house a partially corrugated plate pack with adjacent corrugated sides in such a way as to form a pair of heat exchange circuits for the circulation of fluids and curved edges connecting the two adjacent sides, designed in such a way as to form channels for the passage of said fluids belonging to the respective circuits.

The corrugated sides of the partially corrugated sheet metal guarantee high thermal exchange, due both to the large surface area and to the fact that they induce a vortex movement in the fluids in such a way as to reach all parts of the heat exchanger, guaranteeing that heat exchange takes place even in peripheral zones.

ILLUSTRATION OF DRAWINGS

Other features and advantages of the invention will become evident on reading the following description of an embodiment of the invention, given as a non-binding example, with the help of the enclosed drawings in which FIGS. 1 to 4 represent diagrammatic views in side elevation of part of the plant for producing partially corrugated sheet metal during different and successive phases of the work cycle.

DESCRIPTION OF A PREFERRED FORM OF EMBODIMENT

In the figures, the reference number 10 generally indicates plant for producing partially corrugated sheet metal 11 according to the invention.

The plant 10 comprises:

a roll-holder 12 for the sheet metal 11, a loop control device 13, a pair of opposing cylinders 14, 15, a press brake 16 a pair of mobile carriages 17, 18 mounted on appropriate guides at the sides of the advancing sheet metal 11 and equipped with appropriate gripping means 19, 20 of the edges of the sheet metal 11, a pick-up device of the partially corrugated sheet metal 11 from the press brake 16.

Downstream of the press brake 16, the plant typically comprises a shearing machine (not shown in the figures) to cut the partially corrugated sheet metal 11 into pre-established lengths.

The plant is also equipped with sensors (not illustrated) distributed along the path taken by the sheet metal 11 and in correspondence to the previously described elements, electrically connected to an electronic control unit (not illustrated) provided to programme and control the entire procedure.

The roll-holder 12 may consist of an idle reel on a respective support and is designed to feed the plant 10 with the sheet metal 11 on the reel.

According to a particularly advantageous embodiment of the invention, the sheet metal is aluminium with optimum ductility and deformability and a thickness of, for example, 0.16 millimeters.

Also covered by the invention are, of course, embodiments according to which the sheet is made from other metal or appropriate alloys and of different thickness.

Experiments carried out by the applicant have shown that extremely thin sheet metal as thin as 0.1 mm may be used.

The lateral surface of each of the opposing cylinders 14, 15 has corrugations 21 arranged transversally with respect to the infeed direction of the sheet metal 11, together with flat bands 22.

The cylinders 14, 15 are kinematically connected to any appropriate source of motion, for example, an electric motor (not shown in the drawings).

The cylinders 14, 15 may be designed as transfer devices of the sheet metal 11 to unwind it from the reel 12 and direct it towards the press brake 16. The loop control device 13 located downstream of the reel 12 may comprise a pair of sensors connected to the electronic control unit acting in such a way as to maintain the transfer speed constant.

In certain sections, for example upstream of the press brake 16, the plant 10 may have guides (not illustrated) provided to keep the sheet metal 11 under sufficient tension and correctly oriented along the straight path to be followed within the plant.

The press brake 16 comprises a bed plate 29 supporting guides housing the respective sliding carriages 17, 18 each equipped with gripping means 19, 20 of the sheet metal 11.

In addition, said carriages 17, 18 are connected to a means of movement in turn kinematically connected to a respective source of motion and the electronic control unit.

A punch 35 slides within a special vertical guide 36 in correspondence to the central work position of the carriages 17, 18 and moves largely at right-angles to the direction of movement of the carriages.

A counter punch 37 is aligned with the punch 35 and positioned on the opposite side of the sheet metal 11. The carriages 17, 18 are constrained to move with a straight motion towards each other then apart between a central work position when the distance between them is at a minimum to a reciprocally distant position at the beginning of the folding cycle of the sheet metal 11.

During the folding cycle, the punch 35 is free to move from a stand-by position, distant from the sheet metal 11, to a working position below the plane of the sliding sheet metal.

The counter punch 37 is free to move from a stand-by position distant from the sheet metal 11 to a working position in which it is in contact with the sheet 11 pushed down by the punch 35.

The slide guides are equipped with end stop sensors (not shown) electrically connected to an electronic control unit in order to detect correct operation of the carriages 17, 18, the punch 35 and the counter punch 37 respectively.

The punch 35 may comprise a straight bar with a rounded profile and as long as the width of the sheet metal 11, made from metal with a high surface hardness.

This bar is fixed to the end of a plate 36 mobile in a vertical direction, being connected to appropriate means of drawing and guiding (not illustrated). In the same way, the counter punch 37 comprises a bar fixed to the end of a plate 38 connected to appropriate means of drawing and guiding (not illustrated). The gripping means 19, 20 may consist of grippers to temporarily constrain the sheet metal 11 to the respective carriages 17, 18 during folding.

The procedure to obtain the partially corrugated sheet metal 11 comprises:

provision of a roll of sheet metal 11 to feed a respective means of unrolling and transferring the sheet 11 itself;

compression of the sheet metal 11 by means of pressing cylinders 14, 15 configured in such a way as to produce transverse corrugations alternating with flat sections on the sheet 11;

a loop control device 13 at the exit of the unrolling reel 12, together with sensors to detect the correct infeed of the sheet metal 11 and transmit the relative signal to an electronic control unit to programme and control the entire procedure;

transfer of the sheet metal 11 towards the press brake 16 to fold the sheet, parallel to the axis of the corrugations, in correspondence to the central portion of each flat section, and in the opposite direction to the fold of the previous flat section in such a way as to obtain a coil of sheet metal 11 with corrugations on adjacent sides;

extraction of the corrugated sheet 11 from the press brake 16 and shearing of said sheet 11 into pre-established lengths.

Figure 2:
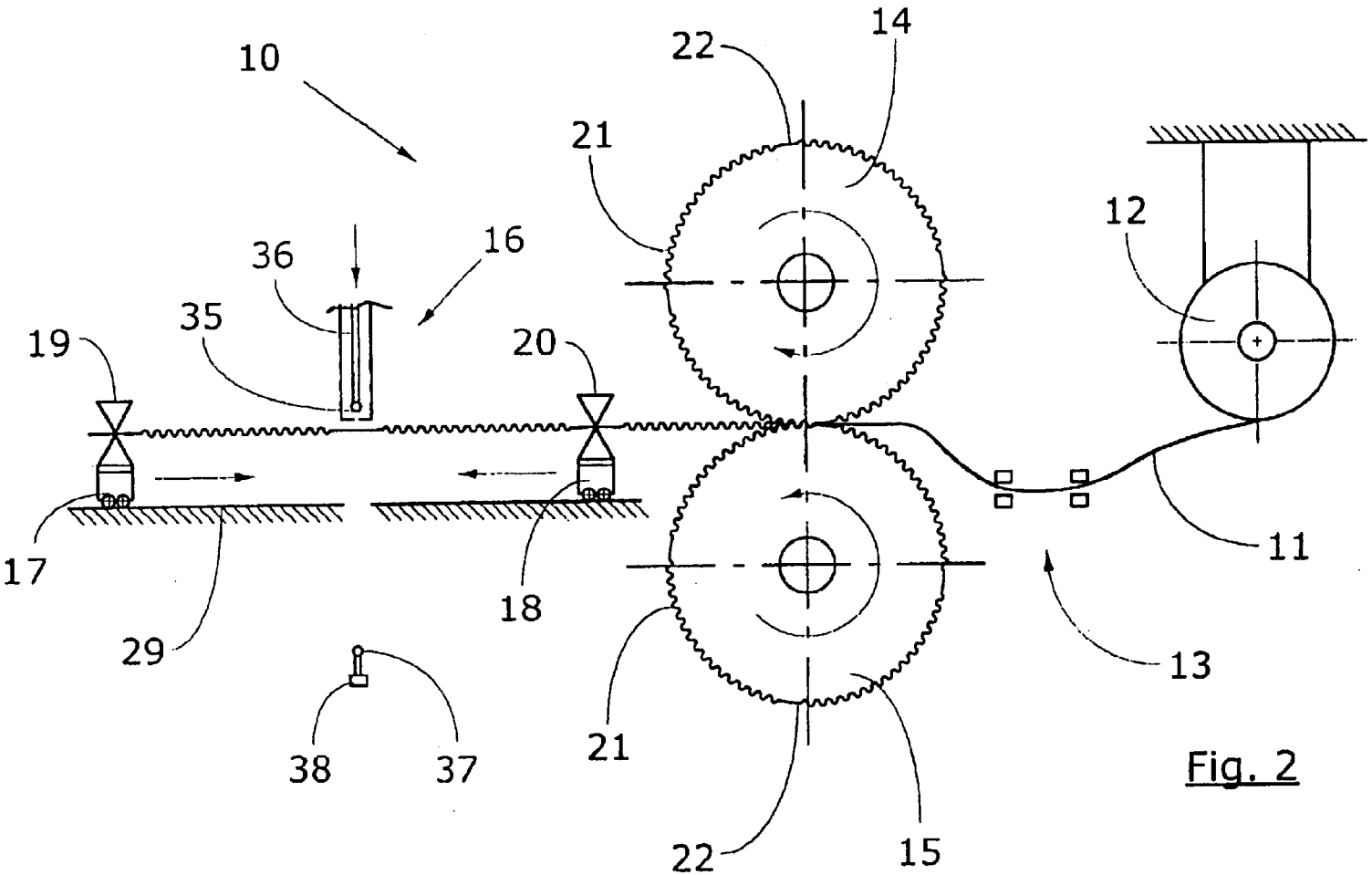
Figure 3:
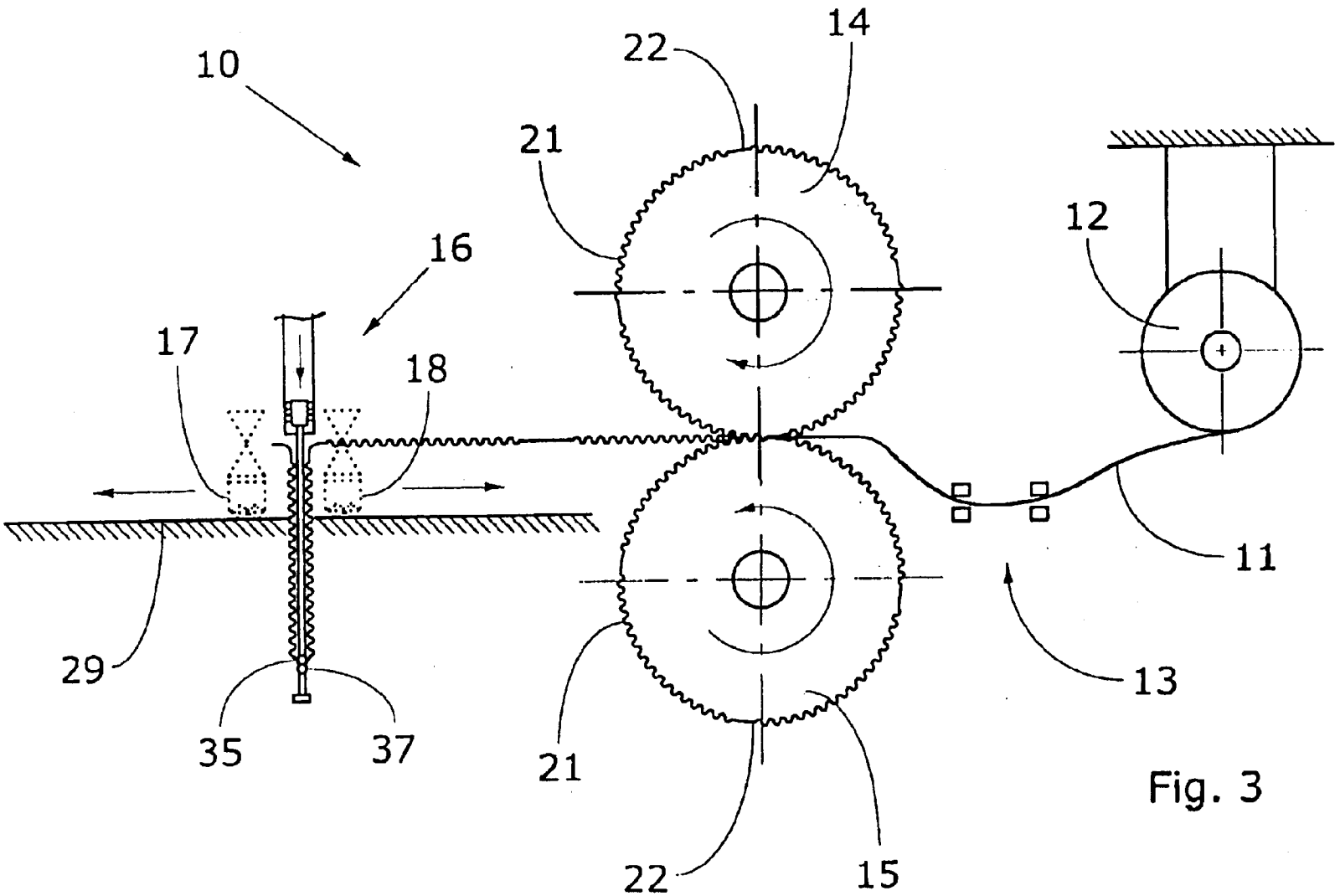
Figure 4:
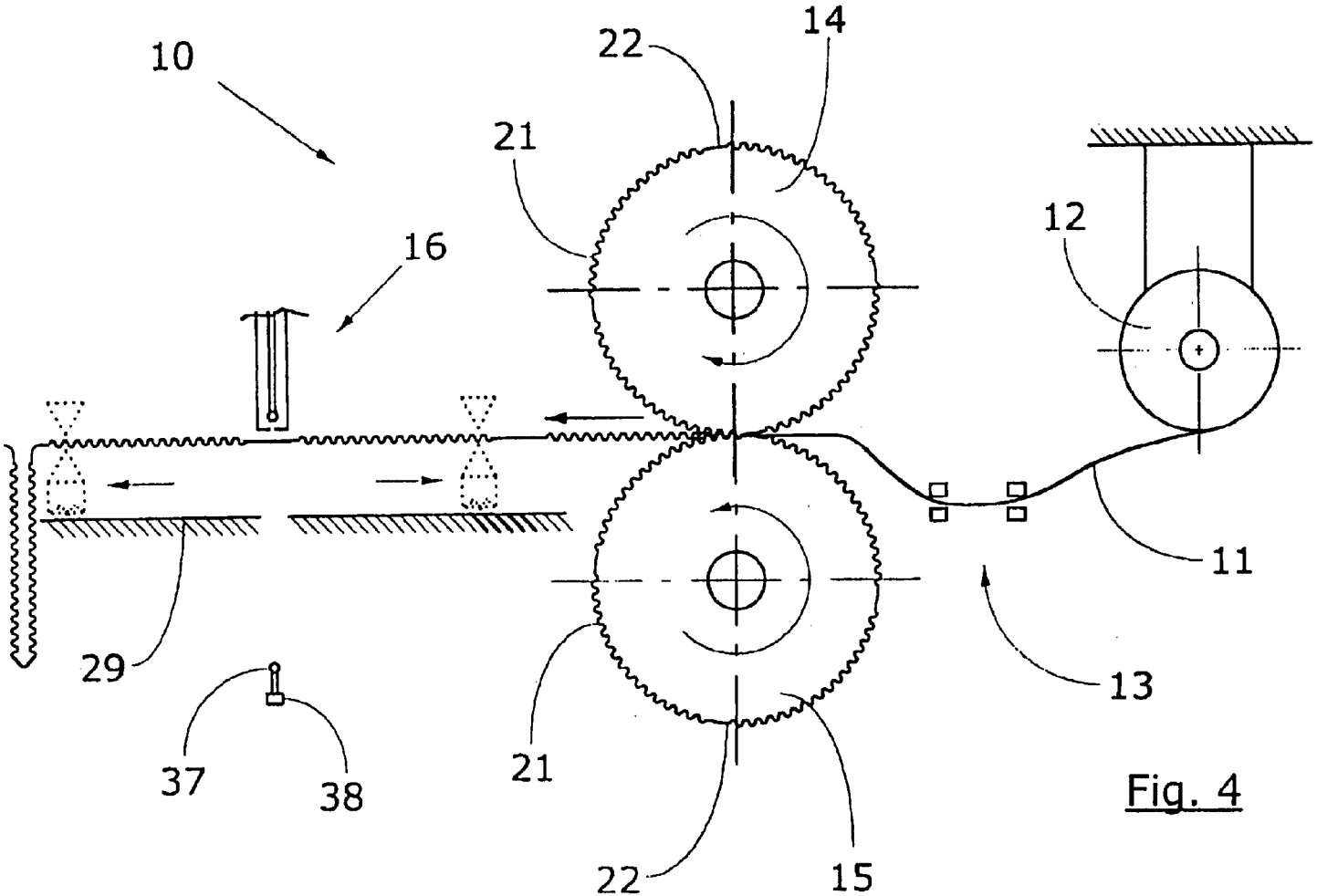

Inside the press brake 16, the edges of the sheet metal 11 are held by gripping means 19, 20 while the punch 35 descends towards it until it reaches below the slide plane of the carriages 17, 18, deforming the sheet in correspondence to a flat section (see FIGS. 2, 3).

At the same time as the punch 35 is lowered, the counter-punch 37 is positioned on opposite side of the sheet metal to that in contact with the punch 35. At this point the sheet metal is folded thanks to the combined action deriving from the movement of the carriages 17, 18 towards each other and the descent of the punch 35 towards the corresponding counter-punch 37.

After the folding phase, the gripping means 19, 20 of the carriages 17, 18 release the partially corrugated sheet metal 11 ready to grip another sheet 11 coming from the loop control device 13. The carriages then move apart (FIG. 4) and return to the starting position (FIG. 1).

The partially corrugated sheet metal 11 thus obtained comprises a relatively thin metal plate with a number of adjacent corrugated sides linked by flat sections with an alternating curvature in such a way as to form a coil, preferably with a constant pitch.

Such a structure is particularly appropriate for obtaining a plate pack for an air-air heat exchanger for cooling electrical cabinets.

In this case, the edges of the structure are suitably sealed either manually or automatically in such a way as to define a pair of heat exchange circuits for cooling the air inside an electrical cabinet according to a process known in background art.

Experiments carried out by the applicant have shown that the efficiency of such an air-air heat exchanger is surprisingly higher than what could be expected by a reasonably qualified technician.

Given that a heat exchanger with corrugated walls has a heat exchange surface area about 20–25% greater than a heat exchanger with flat walls, it was found that, for the same external dimensions, an air-air heat exchanger with corrugated walls constructed following the procedure described above has a thermal efficiency more than 40% higher than a heat exchanger with flat walls.

This is due both to the greater length of time the air remains inside the exchange circuits and to the improved distribution of air within the volume enclosed between the two opposite walls.

As previously mentioned, the partially corrugated sheet metal 11 may consist of an aluminium sheet with a thickness of 0.16 millimeters.

The invention may, however, be constructed with a different thickness sheet, in particular, with a sheet as thin as 0.1 mm.

The pitch of the coil may be 10 millimeters while the pitch of the corrugations on the sides is, for example 5 millimeters.

The corrugations, may be 2.5 millimeters deep from crest to bottom. The plate 11 may be up to 900 millimeters wide.

The rounded surface of the punch 35 may have a diameter of 3 millimeters.

All the dimensions previously mentioned are indicative only and do not in any way represent a limitation of this invention.

The invention is described above with reference to a preferred embodiment. However, the invention is obviously open to numerous technically equivalent variations.

What is claimed is:

1. A method of obtaining a partially corrugated sheet metal, comprising providing a roll of rolled up sheet metal having a first end;

feeding said first end to a respective means of unrolling said first end off of said roll and transferring said unrolled first end as an infeed sheet metal;

compressing said infeed sheet metal in such a way as to produce a series of transverse corrugations alternating with flat sections so as to form a partially corrugated sheet metal;

transferring said partially corrugated sheet metal towards a press brake by sliding the partially corrugated sheet metal to the press brake;

gripping partially corrugated sheet metal with grippers mounted on sliding carriages;

positioning the partially corrugated sheet metal in such a way that the grippers are on opposite sides of a punch;

folding the partially corrugated sheet metal by simultaneously moving the sliding carriages towards each other, moving the punch vertically downwards onto the partially corrugated sheet metal, and moving a counter-punch vertically onto the partially corrugate sheet metal, in such a way as to obtain a coil of partially corrugated sheet metal;

extracting the partially corrugated sheet metal from the press brake; and shearing said corrugated sheet metal into pre-established lengths.

2. A method according to claim 1, further comprising constantly monitoring an unrolling speed of the roll of sheet metal, controlling a longitudinal stability of the infeed sheet metal by detecting correct infeed alignment of said infeed sheet metal, according to a predetermined standard of alignment and transmitting an indicating signal to an electronic control unit.

3. A method according to claim 1, wherein the partially corrugated sheet metal comprises a thin metal plate with a number of adjacent corrugated sides linked by flat section with an alternating curvature in such a way as to form a coil, preferably with a constant pinch.

4. A method according to claim 3, wherein the partially corrugated sheet metal is made of aluminum alloy.

5. A method according to claim 3, further comprising using the partially corrugated sheet metal to make a high thermal efficiency heat exchanger comprising a plate pack, wherein said plate pack includes of at least a pair of sheets of partially corrugated sheet metal, and separate circuits for the circulation of fluids within said heat exchanger.

6. A plant to produce a partially corrugated sheet comprising:

a roll holder for a roll of sheet metal;

a pair of opposing cylinders to form the partially corrugated sheer metal, the pair of opposing cylinders being connected to a source of motion that makes the opposing cylinders rotate, the pair of opposing cylinder having transverse corrugations parallel to the central axis of the cylinder on the outer surface of the cylinder, the pair of opposing cylinders having flat longitudinal bands on the outer surface; and a press brake to fold the partially corrugated sheet metal the press brake comprising:

sliding carriages supported on a bed plate, the sliding carriages being equipped with gripping means to grip the partially corrugated sheet metal, the sliding carriages being able to slide towards each other, or apart from each other, while moving in parallel to a surface of the partially corrugated sheet metal, the sliding carriages being moved by a source of motion, the sliding carriages being coupled with guides to keep a straight movement of to sliding carriages;

a punch located over a central work position of the bed plate, the punch being able to slide vertically at a right angle onto the corrugated sheet metal; and a counter-punch aligned below said punch and positioned on the opposite side of the corrugated sheet metal, the counter-punch being able to slide vertically at a right angle onto the corrugated sheet metal.

* * * * *